US007298276B2

(12) United States Patent
Perez Garcia

(10) Patent No.: US 7,298,276 B2
(45) Date of Patent: Nov. 20, 2007

(54) ELECTRONIC PERSONNEL CONTROL AND SAFETY DEVICE

(76) Inventor: Antonio Perez Garcia, Leonardo da Vinci, 25-27 atico 1°, Sabadell, Barcelona (ES) 08204

( * ) Notice: Subject to any disclaimer, the term of this patent is extended or adjusted under 35 U.S.C. 154(b) by 0 days.

(21) Appl. No.: 10/507,138

(22) PCT Filed: Mar. 26, 2004

(86) PCT No.: PCT/ES2004/000136

§ 371 (c)(1),
(2), (4) Date: Sep. 9, 2004

(87) PCT Pub. No.: WO2004/101075

PCT Pub. Date: Nov. 25, 2004

(65) Prior Publication Data

US 2005/0146432 A1 Jul. 7, 2005

(30) Foreign Application Priority Data

May 14, 2003 (ES) ..... 200301117

(51) Int. Cl.
*G08B 23/00* (2006.01)

(52) U.S. Cl. ..... 340/573.1; 340/539.11; 340/539.13; 340/825.49; 701/211

(58) Field of Classification Search ..... 340/573.1
See application file for complete search history.

(56) References Cited

U.S. PATENT DOCUMENTS 3,969,720 A 7/1976 Nishino
4,600,914 A 7/1986 Walsh
5,757,273 A * 5/1998 Crandall et al. ..... 340/573.1
5,990,793 A 11/1999 Bieback
6,091,331 A 7/2000 Toft et al.
6,198,394 B1 * 3/2001 Jacobsen et al. ..... 340/539.12
6,199,550 B1 * 3/2001 Wiesmann et al. ..... 340/521
6,606,993 B1 * 8/2003 Wiesmann et al. ..... 340/573.1
6,894,612 B2 * 5/2005 Xydis ..... 340/539.13
2002/0008625 A1 * 1/2002 Adams et al. ..... 340/573.1
2004/0021569 A1 * 2/2004 Lepkofker et al. ..... 340/539.13
2004/0174269 A1 * 9/2004 Miller et al. ..... 340/539.13

* cited by examiner

*Primary Examiner*—Benjamin C. Lee
*Assistant Examiner*—Eric M. Blount
(74) *Attorney, Agent, or Firm*—Ostrolenk, Faber, Gerb & Soffen, LLP

(57) ABSTRACT

Electronic equipment for safety and control of workers who work in risky conditions, which consists of data and voice repeaters that form a "guide line" that also act as an audible and visible reference in low visibility conditions, the repeaters communicating with the personalised devices attached to the arm of each fire fighter to indicate their state by means of a motion sensor. The personalised fire fighter devices also transmit to the repeaters the signals received from the pressure gauges for each fire fighter using the ABU's (autonomous breathing units). The signals sent by the repeaters are transmitted to the central system, which forwards them to a computer where all the information is displayed. The central system also emits signals to the fire fighters, either directly or through the repeaters. The personalised device turns on automatically when it detects motion.

5 Claims, 2 Drawing Sheets

ELECTRONIC PERSONNEL CONTROL AND SAFETY DEVICE

OBJECT OF THE INVENTION

The present invention relates to an electronic equipment for safety and control of workers who work in risky conditions, such as fire fighters, rescue teams or miners. It is conceived to control workers working to extinguish fires in households, large premises and particularly in garages, tunnels, underground trains and large enclosed spaces.

BACKGROUND OF THE INVENTION

In cases in which there is a great distance between the entrance of the building and the location of the fire, autonomous air units are employed for breathing, as protection against the toxic fumes produced by combustion. These autonomous air units consist of compressed air bottles that provide air for a limited time. Therefore, a limited time is available to locate the fire and then reach the exit of the building.

An added hazard to work in risky conditions is the difficulty of communication with the exterior. Furthermore, there are no points of reference of the path followed and it is possible to become disoriented and be lost when trying to find the exit, as the work is performed in an unfamiliar place without illumination. Yet another disadvantage is that vision is severely impaired by the fumes.

The only control system for workers who work in risky conditions currently available consists of a table and a board. The safety manager located outside the building or area involved notes the workers and time of entry in the building on the board. Any fire fighter entering the premises, tunnel or underground train must hand in a personal badge to the safety manager. The latter will insert this badge in grooves made in the board and note its time of delivery. When the fire fighter exits the badge is returned to him or her. This system allows knowing the number of persons and time of permanence inside the building, premises, garage, tunnel, etc.

Another existing safety element consists of a pressure gauge coupled to the air bottle used to breathe in contaminated atmospheres. These pressure gauges indicate the air pressure inside the bottle and the remaining breathing time. They also indicate the external temperature and include a dead-man alarm. This information is not communicated to the exterior.

Currently, the demand for controlling workers working in risky conditions is not met as relates to their state and location. Also not resolved is the problem of communication with the exterior of the workers working inside buildings, basements, garages or tunnels.

DESCRIPTION OF THE INVENTION

The electronic safety equipment proposed by the invention consists of a "guide line" comprised of transmitting-receiving repeaters operating in radio frequency transmitting certain messages that inform the central control unit of the state of the workers inside the affected area.

The full system comprises four differentiated parts:

a) Repeaters: modules based on which the "guide line" is formed.
b) Fire fighter unit: personalised unit attached to the arm of each fire fighter.
c) Pressure gauge: apparatus included in each compressed air breathing unit (ABU).

d) Central system: system that collects all transmissions and emits them towards a computer where all the information is analysed and displayed. It simultaneously sends information to the fire-fighter's personalised unit.

The equipment controls and locates at all times the workers working in risky situations from outside the building. The system is automatically activated from the beginning of the intervention by a personalised motion sensor carried by each fire fighter. The electronic unit enables both voice and data communication between the exterior and the interior. The pressure gauge informs the fire fighter of the air consumption and indicates the central system in the exterior the maximum time that the workers breathing with autonomous air units can remain inside. The internal working temperature is transmitted to the central system.

The repeaters incorporate an audible and visual signal to inform the fire fighter of the path followed, preventing him or her from becoming lost in a closed space, even with zero visibility. The "guide line" formed by the repeaters indicates the fire fighter the route to follow to exit the area, and shows others the route to follow to reach him or her.

The system detects from the outside whether a fire fighter needs help and informs of the location of this fire fighter, as each one is located by the position of the unit with respect to the nearest repeater. If a fire fighter remains in the same place for more than thirty seconds it will define the exact location. The electronic equipment controls, informs, detects and alerts the exterior at all times of the state and operation of the equipment. If a fire fighter is buried his precise location can be known by a receiver with a unidirectional antenna.

PREFERRED EMBODIMENT OF THE INVENTION

Figure 1:
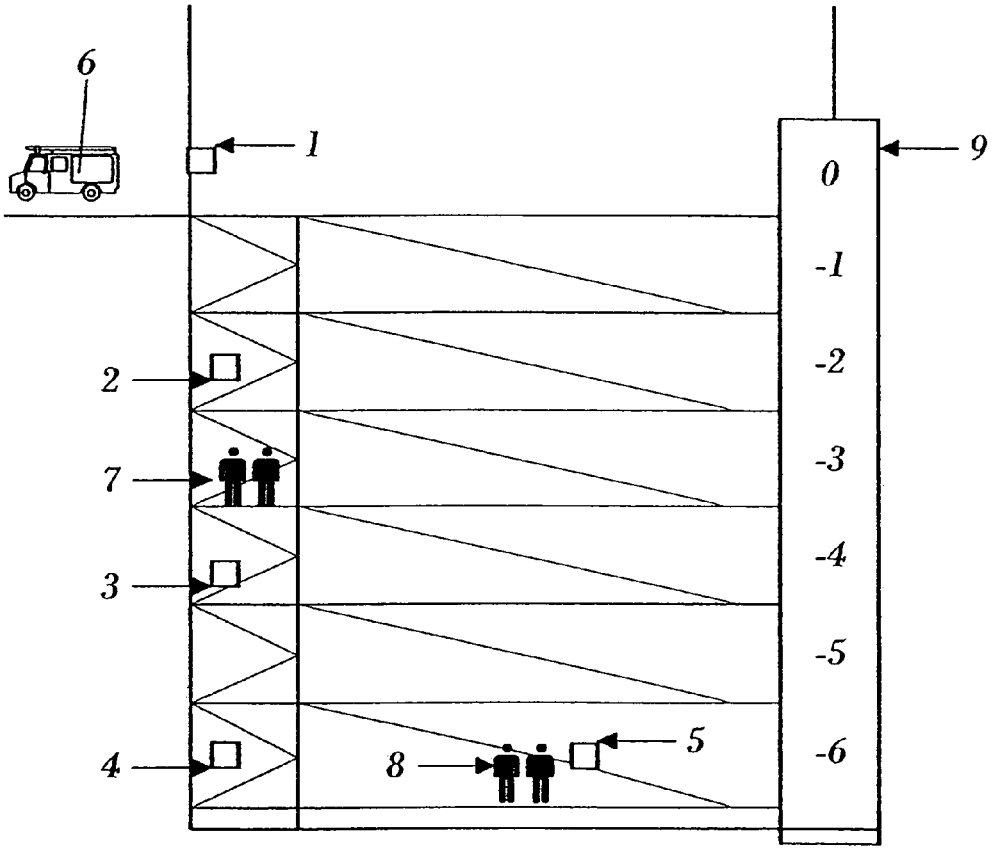
FIG. 1 is an illustration of electronic equipment for safety and control of workers in accordance with an embodiment of the present invention showing the emergency workers (fire fighter) and the repeaters forming the guide line.
Figure 2:
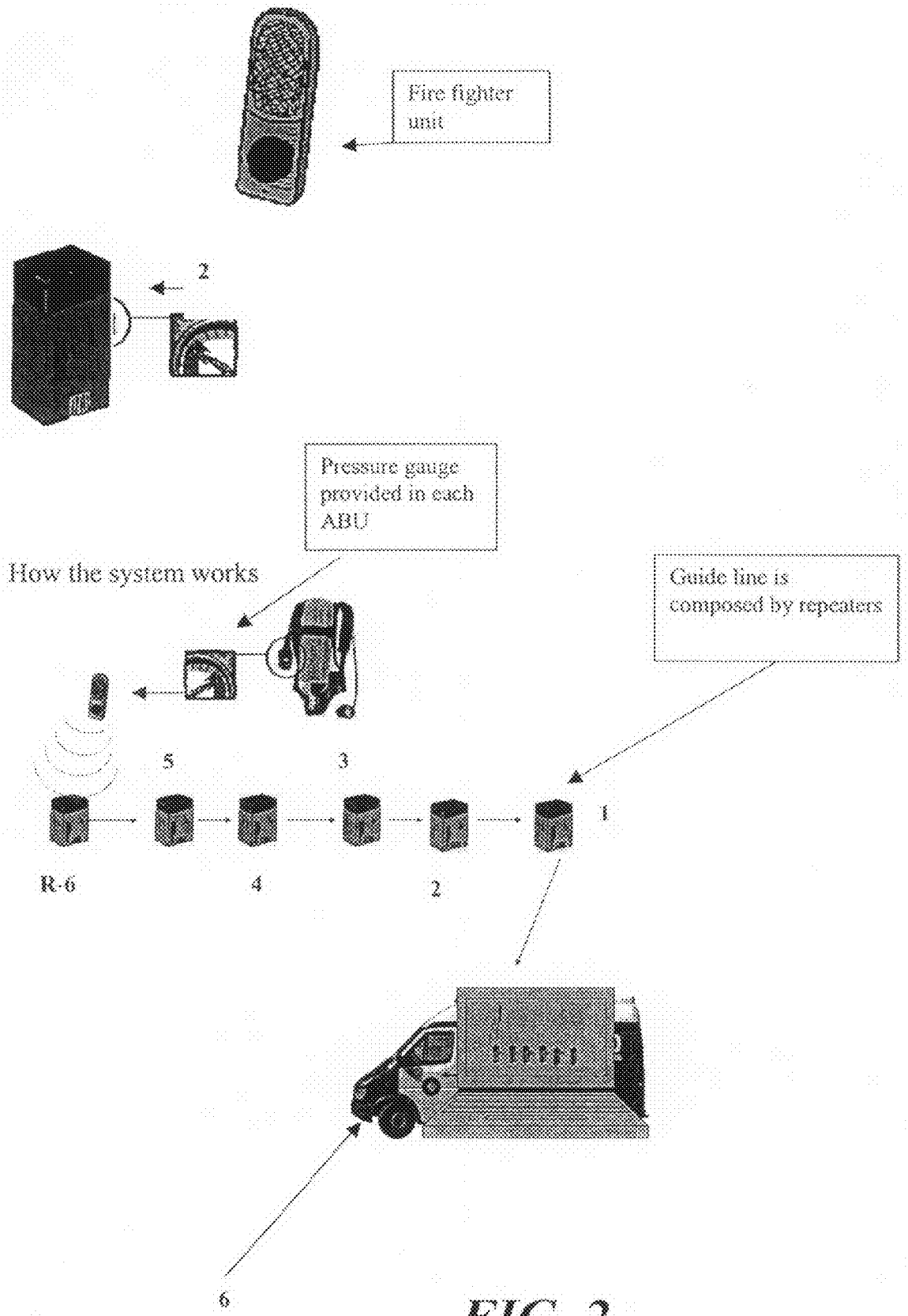
FIG. 2 is an illustration of electronic equipment for safety and control of workers including a personalized fire fighter unit, repeater, pressure gauge and central system and the interaction therebetween in accordance with an embodiment of the present invention.

The electronic equipment for safety and control of workers comprises four differentiated parts: repeaters, fire fighter units, pressure gauges and central system.

The repeaters transmit and receive data in the UN-39 frequency band, 869.3-869.4 MHz with 100 mW power and 25 KHz channelling. They can also act as voice repeaters when the fire fighter carries a radio transmitter (a walkie-talkie), maintaining voice communications with the exterior in places where this would not be possible without the repeater, due to the distance or physical barriers.

When a repeater is started, it must detect its position in the guide line. Each repeater is connected by radio with the adjacent repeaters. The repeater receives the information from the fire fighter's unit and transmits it upstream to the other repeaters toward the central system, transmitting the information generated by the central system downstream to the fire fighter units. The repeater is battery-operated. If one stops working or malfunctions, it is automatically eliminated and the chain is re-established with the nearest repeater assuming its functions, informing the central system of the modifications. Each repeater emits a flashing light.

The audible signals emitted by the repeaters comprise two types of beep: short beeps equivalent to one unit, and long beeps equivalent to five units. The first repeater will emit a short beep (.); the second one will emit two short beeps (..); the third one will emit three short beeps (...); the fourth one will emit four short beeps (....); the fifth one will emit one long beep (_); the sixth repeater will emit one long beep and one short beep (_.); and so on. The repeater audible signals will inform fire fighters of their position at all times, also providing orientation to know the direction to the exit or to another location.

The repeater has two buttons: one is to turn it on and the other is to enter the branching information in the "guide line". The system allows branching of the "guide line" to allow a more thorough coverage of the premises. The repeater also verifies the temperature of the surroundings and sends it to the central system to control the temperature in the various areas in which work is being performed.

The personalised fire fighter's unit is turned on automatically with motion. It emits a sequence indicating that the fire fighter is OK whenever motion is detected. If no motion is detected, a sequence is sent to the central system indicating that a fire fighter is unconscious. If a fire fighter finds another fire fighter unconscious or needs help, a button on the personalised unit can be pressed to emit an SOS sequence to the central system. Each fire fighter shall have a personalised, non-transferable unit. The central system can send a sequence to the fire fighter(s) for immediate exit from the building, translated into a specific beeps signal. The fire fighter unit receives the data frames sent by the pressure gauge and sends them directly to the central system or to the nearest repeater in the direction of the central system. It is battery powered, and when the battery is low it informs the central system. At the end of the service it can be placed on stand-by mode by pressing the button three times, remaining in this state until it is set in motion.

The pressure gauge is automatically activated when the air valve of the ABU (autonomous breathing unit) is opened. It is provided with a LCD screen to inform of the pressure level, the remaining air time in minutes and the battery state. This information is transmitted by radio frames. When the ABU is turned on it must be assigned to the fire fighter using it (by approaching the pressure gauge of the ABU to a sensor in the personalised unit of the fire fighter). After this all the information sent by the pressure gauge by radio (ABU pressure, air consumption, remaining air time and battery state) will only be received by the personalised unit of the fire fighter using it, the latter unit then sending the information on its state and the information received from the pressure gauge to the central system, either directly or through the repeater closest to it.

The central system acts as a receiver for all the information received from the personalised units of the fire fighters, either directly or through the repeaters. It also receives and analyses the information obtained from the repeaters, which arrives from the nearest repeater. The central system also emits signals to the personalised unit, either directly or through the repeaters. In addition to personalised transmissions, it can perform collective transmissions to the personalised fire fighter units, such as the immediate exit signal.

FIG. 1 shows the electronic equipment for safety and control of workers used in an emergency in a set of basements (a parking garage). The basements are numbered according to the reference (9). The central system is located in the fire truck (6). There are four fire fighters inside the parking lot, two in level −3 (7) and another two in level −6 (8). Each one is equipped with the personalised unit that informs the nearest repeater (1, 2, 3, 4 and 5) of their state and provides the information received from the pressure gauge (pressure, remaining air time and ABU state). Each fire fighter's personalised unit is in constant communication with a repeater, which will be the one that receives the signal from the fire fighter unit most strongly (the nearest one).

In the situation of FIG. 1 the information received by the central system shall be that there are two fire fighters (7) located between the repeaters 2 and 3 and that another two fire fighters (8) are located near repeater 5. The personalised fire fighter units will inform on their state and air consumption if they are using ABU's. The various temperatures of the surroundings of the repeaters will also be sent to the central system.

The invention claimed is:

1. Electronic equipment for safety and control of fire fighter workers in a structure comprising:

a) repeaters arranged to form a guide line leading toward an exit of the structure, which receive and transmit voice and data for use in determining positions of the fire fighter workers in the structure;

b) personalized fire fighter units attached to the arm of each fire fighter worker that inform at all times on the status and location of the fire fighter worker and of each fire fighter unit itself;

c) pressure gauges provided in each autonomous breathing unit (ABU) of a plurality of autonomous breathing units used by the fire fighter workers that informs on the air pressure and remaining breathing time; and d) a central system unit that communicates with the personalized fire fighter units either directly or through the repeaters and analyzes the information received with a computer, such that the position of any individual fire fighter worker relative to a repeater in the guide line is determined.

2. The electronic equipment according to claim 1, wherein the repeaters further comprise:

an audio device operable to provide an audible signal in the form of short and long beeps; and a flashing visible signal that shows the fire fighter workers the way out of the structure, wherein each repeater is connected by radio with adjacent repeaters of the guide line and with nearby personalized fire fighter units; and wherein each repeater transmits information upstream from the personalized fire fighter units or from other repeaters to the central system unit, and also transmits information downstream from the central system to the personalized fire fighter units, and further act as a voice repeater when the fire fighter worker carries a radio transmitter, and wherein the repeaters further comprise a thermometer whose measurement is sent to the central system.

3. The electronic equipment according to claim 1, wherein each personalized fire fighter unit is automatically activated by a motion sensor and that emits, when the motion sensor is activated, a sequence indicating that the fire fighter worker is OK to the central system unit or to the nearest repeater, such that the sequence is then sent to the central system unit; and also emits a second sequence indicating that a fire fighter worker is unconscious when no motion is detected over a certain time; and wherein each personalized fire fighter unit is operable to receive data frames sent by the pressure gauge when the fire fighter is using an autonomous breathing unit and is also operable to send them directly to the central system unit or through the nearest repeater, and also operable to receive warnings from the central system.

4. The electronic equipment according to claim 1, wherein each pressure gauge measures the air pressure and the air time in minutes remaining in a bottle of the autonomous breathing unit and displays it together with the operational status of the pressure gauge itself in a LCD display, and wherein each pressure gauge also sends this pressure, time and operational status information by radio to the personalised fire fighter unit of the fire fighter worker assigned to it, wherein this assignation is performed at the start of consumption of the autonomous breathing unit air by bringing the pressure gauge close to the personalised fire fighter unit.

5. The electronic equipment according to claim 1, wherein the central system unit receives the information from the personalised fire fighter units either directly or through a first repeater of the guide line, and which emits personalised or collective transmissions to the personalised fire fighter units either directly or through the first repeater.

* * * * *